US005318119A

United States Patent [19]

Lowry et al.

[11] Patent Number: 5,318,119

[45] Date of Patent: Jun. 7, 1994

[54] METHOD AND APPARATUS FOR ATTACHING WELL SCREENS TO BASE PIPE

[75] Inventors: William M. Lowry; James E. Spangler; Bryant A. Arterbury, all of Houston, Tex.

[73] Assignee: Halliburton Company, Houston, Tex.

[21] Appl. No.: 924,347

[22] Filed: Aug. 3, 1992

[51] Int. Cl.[5] ..... E21B 43/08

[52] U.S. Cl. ..... 166/228; 166/233

[58] Field of Search ..... 166/227, 228, 278, 380, 166/233, 51, 82; 210/510.1

[56] References Cited

U.S. PATENT DOCUMENTS

| | | | |
|---|---|---|---|
| 1,588,920 | 6/1926 | Trahan et al. | 166/228 |
| 2,335,558 | 11/1943 | Young | 166/228 |
| 3,133,595 | 5/1964 | Loughney et al. | 166/228 |
| 3,534,816 | 10/1970 | Showalter | 166/228 |
| 4,018,282 | 4/1977 | Graham et al. | 166/227 |
| 4,284,138 | 8/1981 | Allred | 166/233 |
| 4,700,776 | 10/1987 | Petrovic | 166/157 |
| 4,750,557 | 6/1988 | Gavranovic | 166/51 |
| 4,770,336 | 9/1988 | Arterbury et al. | 228/182 |
| 5,004,049 | 4/1991 | Arterbury | 166/228 |
| 5,088,554 | 2/1992 | Arterbury et al. | 166/228 |
| 5,190,102 | 3/1993 | Arterbury et al. | 166/228 |

*Primary Examiner*—Thuy M. Bui
*Assistant Examiner*—Frank S. Tsay
*Attorney, Agent, or Firm*—Tracy W. Druce; Dennis T. Griggs

[57] ABSTRACT

Multiple sintered metal sand screen sections are mechanically coupled to a perforated screen mandrel in an arrangement which is capable of sustaining normal bending loads associated with run-in in highly deviated and horizontal well bores, without breaking the mechanical connections or otherwise damaging or impairing the structural integrity of the sintered metal screen sections. The multiple screen sections are held under compression by end collars. Adjacent screen sections are separated by annular spacing rings and by resilient seal rings which seal the union between adjacent end portions of the sintered metal screen sections. The end collars are welded directly onto the screen mandrel, with the sintered metal screen sections being stabilized about the perforated mandrel by longitudinal compression loading, so that it is not necessary to form a weld joint on the sintered metal material. Bending stress which would otherwise be imposed on the sintered metal screen sections is relieved by flexure of the resilient seal ring elements.

21 Claims, 8 Drawing Sheets

METHOD AND APPARATUS FOR ATTACHING WELL SCREENS TO BASE PIPE

FIELD OF THE INVENTION

This invention relates generally to well completion apparatus, and in particular to well screens for filtering unconsolidated material out of inflowing well fluid in water, oil, gas and recovery wells.

BACKGROUND OF THE INVENTION

In the course of completing an oil and/or gas well, a string of casing is run into the well bore and then a string of production tubing is run inside the casing. At the well site, the casing is perforated across one or more production zones to allow production fluids to enter the casing bore. During production of the formation fluid, formation sand is also swept into the flow path, and erodes production components.

In some completions, the well bore is uncased, and an open face is established across the oil or gas bearing zone. Such open bore (uncased) arrangements are utilized, for example, in water wells, test wells and horizontal well completions. One or more sand screens are installed in the flow path between the production tubing and the perforated casing (cased) or the open well bore face (uncased). A packer is customarily set above the sand screen to seal off the annulus in the zone where production fluids flow into the production tubing. The annulus around the screen may be packed with a relatively coarse sand or gravel which acts as a filter to reduce the amount of fine formation sand reaching the screen.

DESCRIPTION OF THE PRIOR ART

Conventional sand screens employ a perforated mandrel which is surrounded by longitudinally extending spacer bars, rods or ribs and over which a continuous wire is wrapped in a carefully spaced helical configuration to provide a predetermined longitudinal gap between the wire turns. The gap between turns and the mandrel perforations allow formation fluids to flow through the screen, while the closely spaced wire turns exclude particulate materials such as sand or gravel which may reach the screen.

Fine sand may be carried through the gravel pack before the gravel pack bridge stabilizes. During the early stages of producing the well after gravel packing, those fines tend to migrate through the gravel pack and screen and lodge within the inner annulus between the outer wire wrap and the perforated mandrel. In some instances, this can cause severe erosion of the screen and ultimate failure of the screen to reduce sand invasion.

One approach for overcoming the sand erosion problem is to interpose a prepack of gravel within the annulus between the inner mandrel and the outer wire screen. The prepacked gravel is sized appropriately to exclude the fines which accompany the formation fluid. Raw gravel, as well as epoxy resin coated gravel, have been used extensively in prepacked well screens. Some prepacked well screens are subject to retrieval problems due to their outer diameter being larger than that of a conventional well screen. In order to make prepacked well screens more easily retrievable, the inner mandrel is usually downsized, thereby imposing restrictions on both production and completion tool string bore sizing.

An improved sand screen which can exclude sand fines from inflowing formation fluid without limiting production of the formation fluid has recently been introduced for use in oil and gas wells. The improved sand screen includes a tubular, porous body composed entirely of Sintered, powdered metal. Such a sintered metal sand screen is disclosed in U.S. Pat. No. 5,088,554 assigned to Otis Engineering Corporation, and is hereby incorporated by reference.

The sintered metal sand screen has a unitary, tubular body of inherently stable, aggregate material composed entirely of porous sintered powdered metal. The metal is preferably a corrosion resistant metal, for example, stainless steel or nickel and nickel chromium alloys such as are sold under the trademarks "MONEL" and "INCONEL". Preferably, the sintered metal screen provides a matrix having a pore size of about 20–150 microns, corresponding generally to about 10–60 mesh.

The sintered metal screen is fabricated by an isostatic press technique in which powdered metal of an appropriate particle length, for example, 50–1,400 microns stainless steel slivers, are poured into a tubular mold of the appropriate length and diameter. The powdered metal is then pressed within the mold at about 65,000 psi (4,569 $Kg/cm^2$) for twenty minutes to two hours to form a powdered metal sleeve. The compressed, powdered metal sleeve is then transferred to a sintering oven. Then the porous tubes are heated to a temperature in the range of 1,600–2,100 degrees F (871–1,148 degrees Celsius) for several hours to achieve full bonding of individual grains, leaving pore spaces. After the sintering cycle has been completed, the sintered tubes are allowed to cool, and then undergo further processing and finishing. The result is an all metal, consolidated aggregate screen.

Because helically wrapped wires and longitudinal spacer bars are not utilized, the radial thickness of the sintered metal sand screen body provides the prepack gravel function with the desired porosity without imposing a reduction on the production bore size. Moreover, because of its porosity and large surface area, the sintered metal sand screen is well adapted for use in completions having relatively low entrance velocity of formation fluids, for example, in horizontal completions.

Although the sintered metal sand screen is constructed of inherently stable sintered metal slivers, and can be molded, machined, cut to size and worked in the same manner and with the same tools as conventional production tubing, there are two fundamental limitations on the assembly of a sand screen utilizing the sintered metal tubing sections. First, the maximum length of sintered metal tubing sections which is presently achievable with conventional molds and sintering ovens is in the range of from about 36 inches to 42 inches. Additionally, it has been found that welding causes the body of the sintered metal screen to become relatively brittle as compared with solid metal production tubing, and the weld tends to break in response to normal bending loads and rough handling.

Consequently, the conventional method of direct welding attachment of the sintered metal tubular screen onto a tubular base pipe cannot be used, since the welded region is subject to mechanical separation as a result of rough handling and will eventually cause a channeling failure to occur downhole. This produces an erosive cut leakage path through the screen and generally yields a catastrophic failure. The integrity of the mechanical connection between the sintered metal tubing section and the base pipe is especially critical in view of the rough handling to which it is subjected during transportation and run-in, as well as extreme downhole well conditions, such as a temperature range of from about 50 degrees Celsius to about 300 degrees Celsius, a formation fluid pH of from about 6 to about 12, high formation pressure up to about 2,000 psi, and exposure to corrosive formation fluids containing sulphurous compounds such as hydrogen sulfide or sulphur dioxide in concentrations up to about 20 percent by weight.

OBJECTS OF THE INVENTION

Accordingly, the principal object of the present invention is to provide an improved method and apparatus for attaching a sintered metal screen to a base pipe, which is resistant to stress damage caused by rough handling incurred during transportation or run-in, and which is resistant to corrosive downhole conditions.

A related object of the present invention is to provide an improved method and apparatus for assembling short lengths of sintered metal tubing onto a relatively longer length of perforated base pipe mandrel.

Another object of the present invention is to provide an improved well screen assembly which reduces the radial thickness of screen material without imposing a flow restriction or a strength compromise on the inner mandrel.

Another object of the present invention is to provide a tubular well screen assembly having multiple sections of sintered metal tubing mechanically coupled to a tubular base pipe mandrel in an arrangement which is highly resistant to acid treatment and stimulation compounds, as well as high chloride/high temperature, corrosive well conditions.

Yet another object of the present invention is to provide an improved well screen assembly having multiple sintered metal tubing sections mechanically coupled to a perforated mandrel which is adapted for use in well completions having a relatively low entrance velocity for formation fluids, for example, in highly deviated and horizontal completions.

Yet another object of the present invention is to provide an improved well screen assembly of the character described having multiple sintered metal screen sections which are mechanically coupled to a perforated mandrel in an arrangement which is highly resistant to cracking caused by bending stresses.

Still another object of the present invention is to provide an improved well screen assembly of the character described in which multiple sintered metal sand screen sections are assembled onto a perforated mandrel, in which the sintered metal screen sections are coupled to the tubular mandrel by mechanical means, and without welding the sintered metal tubing sections.

A further object of the present invention is to provide an improved well screen assembly of the character described in which multiple sintered metal sand screen sections are mechanically coupled to a tubular mandrel in an arrangement which is capable of sustaining normal bending loads associated with run-in in highly deviated and horizontal well bores, without breaking the mechanical connections or otherwise damaging or impairing the structural integrity of the sintered metal screen sections.

SUMMARY OF THE INVENTION

The foregoing objects are achieved according to one aspect of the present invention by a well screen assembly in which multiple screen sections are mounted on a perforated mandrel and are held under compression by end collars. Adjacent screen sections are separated by annular spacer rings and by annular, resilient seal rings which seal the union of the annular spacer ring with abutting end portions of the sintered metal screen sections. The end collars are welded directly onto the screen mandrel. According to this arrangement, longitudinal compression loading is utilized to stabilize multiple sintered metal screen sections about the perforated mandrel, without forming a weld on the sintered metal material. Instead, the weld is formed between the end collars and the screen mandrel. Bending stresses which would otherwise be imposed on the sintered metal screen sections is relieved by flexure of the resilient seal ring elements.

According to another aspect of the invention, the tubular screen sections are stabilized about the screen mandrel by compression loading applied on opposite ends by end collars. In this arrangement, the end portions of the screen sections are milled flat to form a right angle annular face for abutment against corresponding annular faces formed on end collars and intermediate spacer collars. In one embodiment, the end collars and spacer collars have tapered neck portions which automatically center the tubular screens about the screen mandrel. In yet another embodiment, concentric alignment of the tubular screen sections is provided by spacer rings and end collars having cylindrical neck portions which are dimensioned for a close, sliding fit within the bore of the tubular well screen section.

Operational features and advantages of the present invention will be appreciated by those skilled in the art upon reading the detailed description which follows with reference to the attached drawings.

DETAILED DESCRIPTION OF THE PREFERRED EMBODIMENTS

Figure 1:
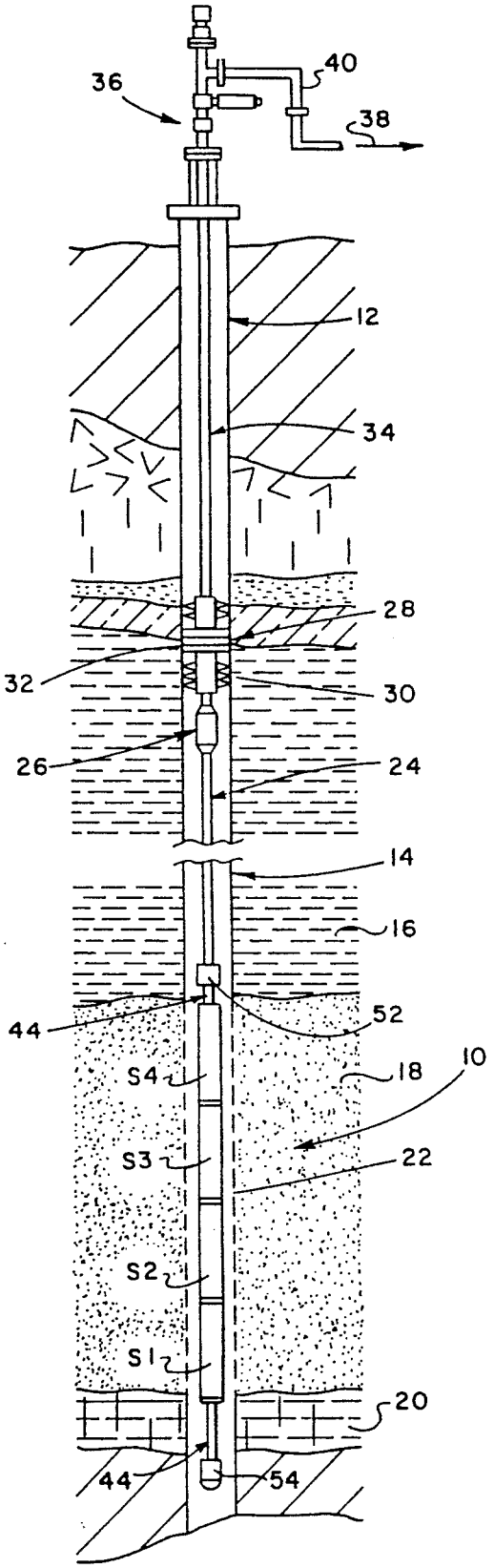
FIG. 1 is a simplified schematic diagram showing a vertical section through a hydrocarbon formation which is intersected by a production well which has been completed with multiple sand screens constructed according to the present invention.

In the description which follows, like parts are indicated throughout the specification and drawings with the same reference numerals, respectively. The drawings are not necessarily to scale and the proportions of certain parts have been exaggerated to better illustrate details of the invention.

Referring now to FIG. 1, a well screen assembly 10 is suspended within a production well 12. A tubular string of well casing 14 extends through multiple layers of overburden 16, traversing a hydrocarbon formation 18, and intersecting one or more layers of underburden 20. The tubular casing sections 14 which intersect the hydrocarbon formation 10 are perforated by multiple openings 22 formed through the casing sidewall to permit inflow of formation fluids from the adjoining hydrocarbon bearing formation 18.

The hydrocarbon formation 18 is confined vertically between the overburden layer 16 and the underburden layer 20, typically of an impervious siltstone or other barren rock. The sand screen assembly of the present invention is particularly well adapted to a generally horizontally aligned hydrocarbon formation, such as the formation 18 as illustrated, having a thickness ranging from about 100 feet to about 500 feet. For illustrative purposes, the hydrocarbon formation 18 is described at a depth of 7,500 feet, with a reservoir pressure of 2,000 psi and a reservoir temperature of 130 degrees F. The overburden layer 16 and the subjacent underburden layer 20 are impervious to the flow of gas.

Figure 2:
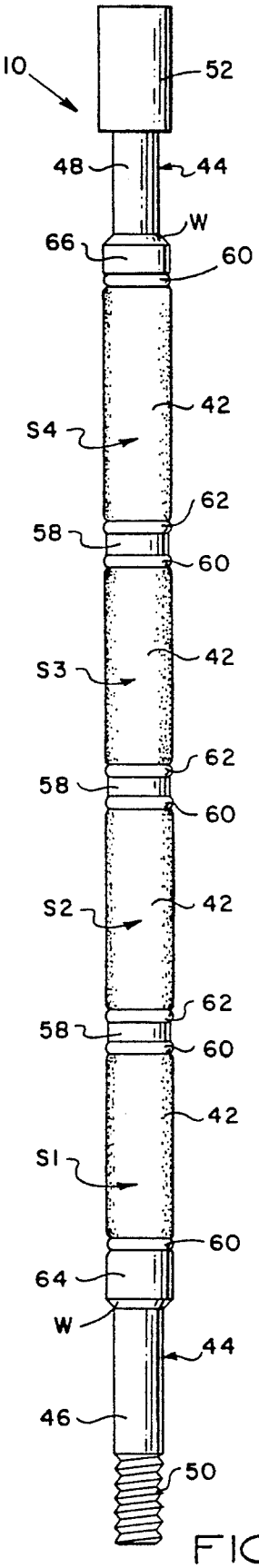
FIG. 2 is a front elevational view of the sand screen assembly shown in FIG. 1, which includes multiple sand screen sections attached to a perforated mandrel.

Referring now to FIG. 1 and FIG. 2, the well screen 10 includes multiple screen sections S1, S2, S3, S4 which are supported by a lower tubing string 24. The lower tubing string 24 is suspended from landing nipple 26 attached to the mandrel of a production packer 28. The production packer 28 includes anchor slips 30 and an elastomeric seal 32 which releasably secure and seal the packer 28 against the bore of the tubular well casing 14. Formation fluid produced through the screens S1–S4 and the production tubing 22 flows to the surface through an upper tubing string 34 to a wellhead assembly 36. The wellhead assembly 36 supports the upper end of the production tubing string 34 and seals the casing 14. Formation fluid 38 is conveyed to a surface reservoir through a production flow line 40.

The sand screen sections S1, S2, S3 and S4 have substantially identical construction, each having a tubular screen body 42 which is a unitary, porous body of sintered powdered metal. The metal preferably is a corrosion resistant metal such as stainless steel or nickel and nickel chromium alloys such as are sold under the trademarks "MONEL" and "INCONEL". In this embodiment, the sintered metal screen body provides a matrix having a pore size of about 100–150 microns, corresponding to 40–60 mesh.

The screen sections S1, S2, S3 and S4 are assembled onto a perforated mandrel 44 which has tubular end portions 46, 48 fitted with threaded pin and box connections 50, 52 for attachment to the lower production tubing 24, and for attachment to a bull plug 54 on its lower end. The bull plug seals the lower end of the sand screen bore, thus constraining the formation fluid 38 to flow through the porous sidewalls 42 and upwardly through the production bores of the tubing string 24 and tubing string 34.

Figure 4:
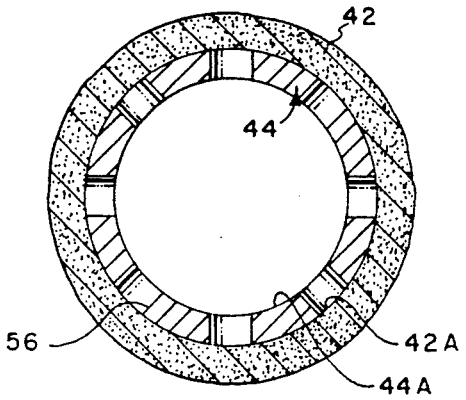
FIG. 4 is a right sectional view taken along the line 4—4 of FIG. 3.
Figure 3:
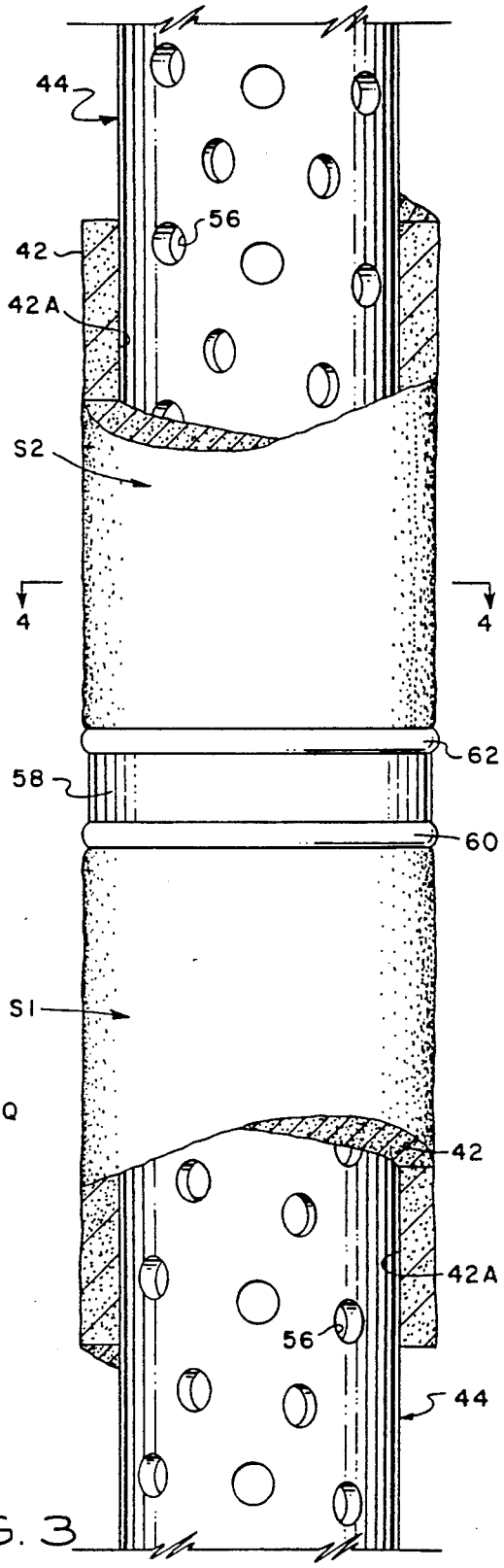
FIG. 3 is a front elevational view, partially broken away and partially in section, of the sand screen shown in FIG. 2.

Referring now to FIG. 2, FIG. 3 and FIG. 4, the construction of the sand screen section S1 is typical of the sand screen sections S2, S3 and S4. The tubular sand screen body 42 is a fluid-porous, particulate-restricting member in the form of a tubular sintered metal sleeve having a length in the range of from about 36 inches to about 42 inches. The tubular sleeve 42 is preferably composed of slivers of metal, for example, stainless steel having a length in the range of from about 50 microns to about 1,400 microns. The stainless steel slivers are compressed and then sintered in an oven to yield a porous body having an average pore size in the range of from about 0.001 inch to about 0.006 inch. Typically, the sintered tube 42 has a radial sidewall thickness in the range of from about 1/16 inch to about ⅛ inch. The sintered metal sleeve provides a flow matrix having a pore size of from about 10–150 microns, corresponding generally to about 10–60 mesh.

The tubular, sintered metal screen sections S1, S2, S3 and S4 are slipped onto the tubular mandrel 44. The tubular mandrel 44 is perforated by radial bore flow passages 56 which follow parallel spiral paths along the length of the mandrel 44. The radial bore flow passages 56 permit fluid flow through the mandrel to the extent permitted by the external sintered metal sand screen sections S1, S2, S3 and S4. The bore flow passages 56 may be arranged in any desired pattern and may vary in number, for example, 30 holes per linear foot or 54 holes per linear foot, in accordance with the area needed to accommodate the expected formation fluid flow through the production tubing 24. The perforated mandrel 44 is fitted on its lower end 46 with the externally threaded pin connection 50 for threaded coupling engagement with the bull plug 54. The internally threaded box connection 52 on its upper end portion 48 is adapted for threaded coupling engagement with the lower end of the production tubing 24. The tubular mandrel 44 has an appropriate length for accommodating the sintered metal screen sections S1, S2, S3 and S4, for example, a longitudinal length of about 20 feet will accommodate four sintered metal screen sections having a length of about 42 inches each, and including standard pin and box fittings.

Figure 5:
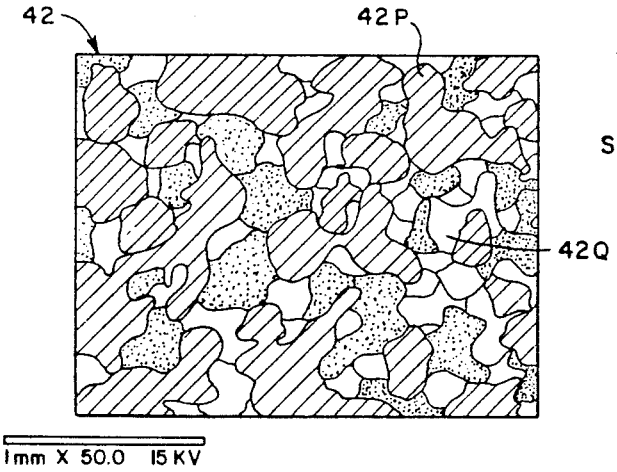
FIG. 5 is an enlarged pictorial representation of a microscopic section taken through an external surface region of a sintered metal sand filter made according to the present invention.

The microscopic section shown in FIG. 5 illustrates the matrix pores 42A within the sintered metal body 42. Pore openings 42Q are formed between sintered metal particles 42P, and have a pore size of about 10–150 microns. This will permit passage of fines in the range of 74–100 microns, but will exclude larger particles which may cause plugging.

It will be understood that multiple sintered metal screen sections 42 may be assembled on a screen mandrel 44 of any convenient length. However, as noted above, a weld joint should not be formed directly on the sintered metal body 42. A further requirement is that the interface between adjoining screen sections should be sealed to prevent the passage of sand fines through the interface region. Moreover, the mechanical union between adjacent sand screen sections should be yieldable to accommodate bending stresses without breaking, for example, during transportation or rough handling in connection with run-in operations, for example, in a highly deviated or horizontal completion.

Figure 6:
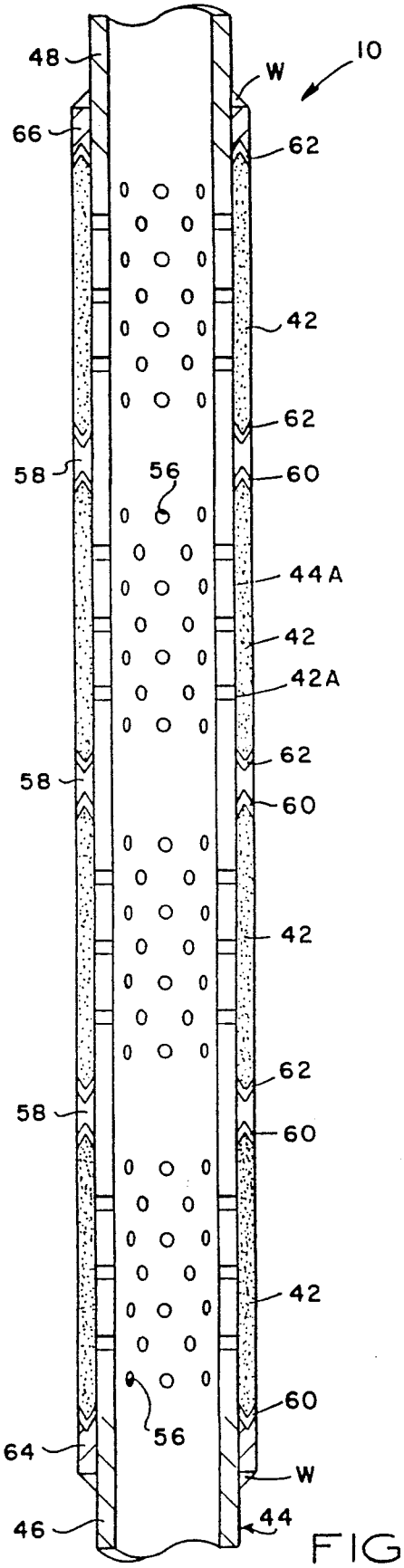
FIG. 6 is a longitudinal sectional view of the sand screen assembly shown in FIG. 2.
Figure 7:
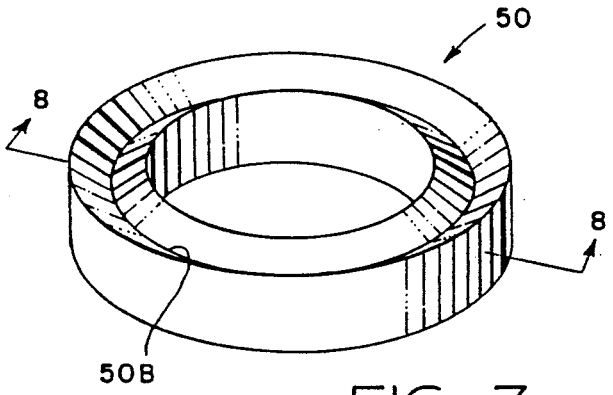
FIG. 7 is a perspective view of a coupling collar used in the construction of the sand screen assembly of FIG. 6.
Figure 8:
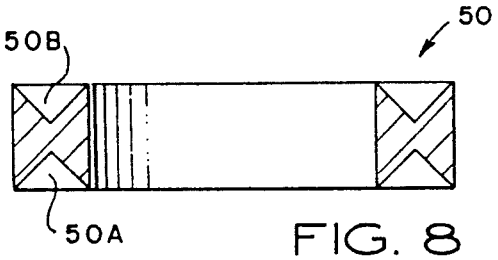
FIG. 8 is a right sectional view taken along the line 8—8 of FIG. 7.
Figure 9:
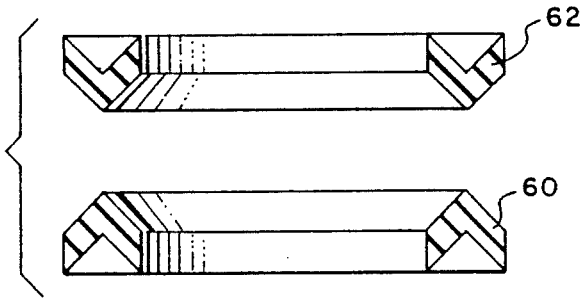
FIG. 9 is a right sectional view of a resilient seal used in the construction of the sand screen assembly shown in FIG. 6.
Figure 10:
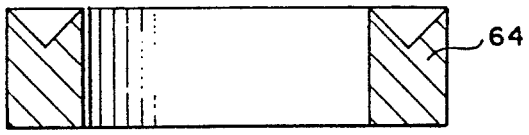
FIG. 10 is a right sectional view of a coupling collar which is used in the construction of the sand screen assembly shown in FIG. 6.

Referring now to FIG. 2, FIG. 3 and FIG. 6, the stated objects of the invention are achieved by mechanically coupling the screen sections together by an annular spacer ring 58 and by first and second annular seal rings 60, 62. The body of the annular spacer ring 50 is intersected by a lower V groove 50A and an upper V groove 50B, which are dimensioned for tight, nesting engagement by the annular seal rings 60, 62, respectively.

The annular spacer ring 50 is preferably constructed of a corrosion resistant, stainless steel alloy, and the annular seal rings 60, 62 are preferably constructed of a resilient, elastomeric material having properties compatible with the expected downhole pressure, temperature and corrosive environment conditions.

According to this arrangement, the multiple screen sections are mounted about the screen mandrel 44 and are held under compression by end collars 64, 66, respectively. The end collars 64, 66 are identical in construction, and are formed from a corrosion resistant metal such as stainless steel. The adjacent screen sections are separated by the annular spacing rings 58 and by the resilient seal rings 60, 62, which seal the adjacent end portions of the sintered metal screen sections. The end collars 64, 66 are welded directly onto the screen mandrel by welds W. According to this arrangement, longitudinal compression loading is utilized to stabilize the multiple sintered metal screen sections 42 about the perforated mandrel 44, and it is not necessary to form a weld joint on the sintered metal material. Instead, the weld is formed between the end collars 64, 66 and the screen mandrel 44. Bending stress which would otherwise be imposed on the sintered metal screen sections is relieved by flexure of the resilient seal ring elements 60, 62.

Figures 11, 12, 13:
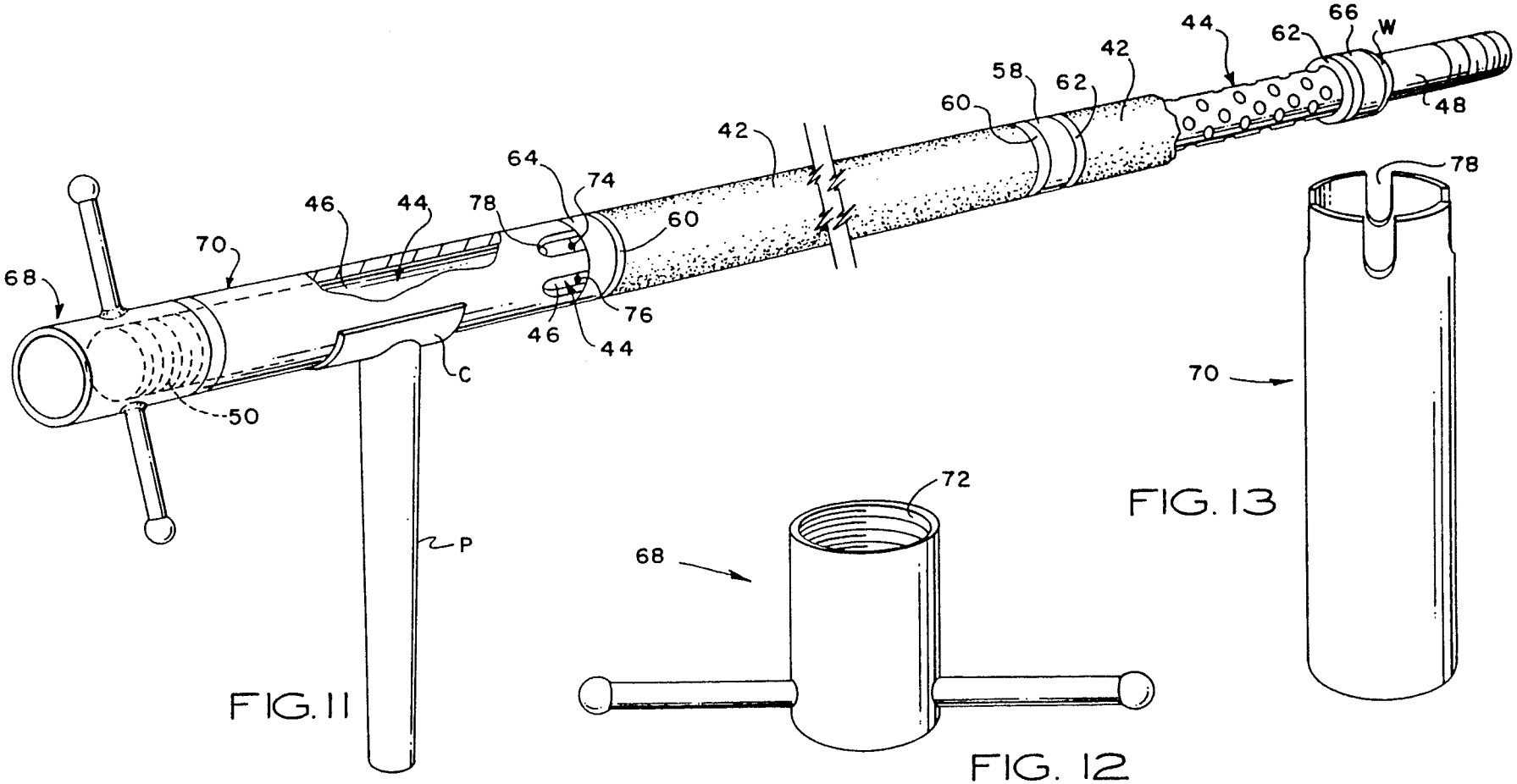
FIG. 11 is a perspective view of an assembly station showing the tools used for assembly of the sintered metal sand screen sections onto a perforated mandrel.
FIG. 12 is a perspective view of the compression tool shown in FIG. 11.
FIG 13 is a perspective view of a tubular extension tool.

Referring now to FIG. 11, FIG. 12 and FIG. 13, multiple sintered metal screen sections 42 are assembled onto a length of perforated screen mandrel 44, with spacer rings 58 and annular seal rings 60, 62 being inserted between adjacent screen sections. First, the end collar 66 is welded onto the upper end portion 48 of the perforated mandrel 44. Next, an annular seal ring 62 is fitted against the annular face of the end collar 66. Thereafter, the appropriate number of well screen sections 42, along with annular seal rings and spacers, are assembled onto the perforated mandrel as shown in FIG. 11. The well screen assembly is supported at each end by support posts P, with the end portions resting within cradles C.

Longitudinal compression loading of the assembled sintered metal screen sections 42 is achieved by a torque tool 68 and a tubular extension tool 70. The torque tool 68 has threads 72 which are adapted for engaging the threaded end portion 50 of the screen mandrel 44. The extension tool is driven against the lower end collar 64 as the torque tool is tightened. A predetermined level of compression is induced by turning the torque tool 68 until a slight bulge in the seal rings 60, 62 is detected. The loading is then relieved by turning the torquing tool in the opposite direction until the bulging disappears.

After the desired level of compression loading has been established, the lower end collar 64 is spot welded at multiple spot weld points 74, 76 which are formed on the underlying screen mandrel 44. For this purpose, the end of the extension tool 70 is intersected by longitudinal slots 78 to expose the underlying screen mandrel surface. After the spot welds have been formed, the torque tool 68 and extension tool 70 are removed, and a full weld joint W is formed between the end collar 64 and the screen mandrel 44.

Figure 14:
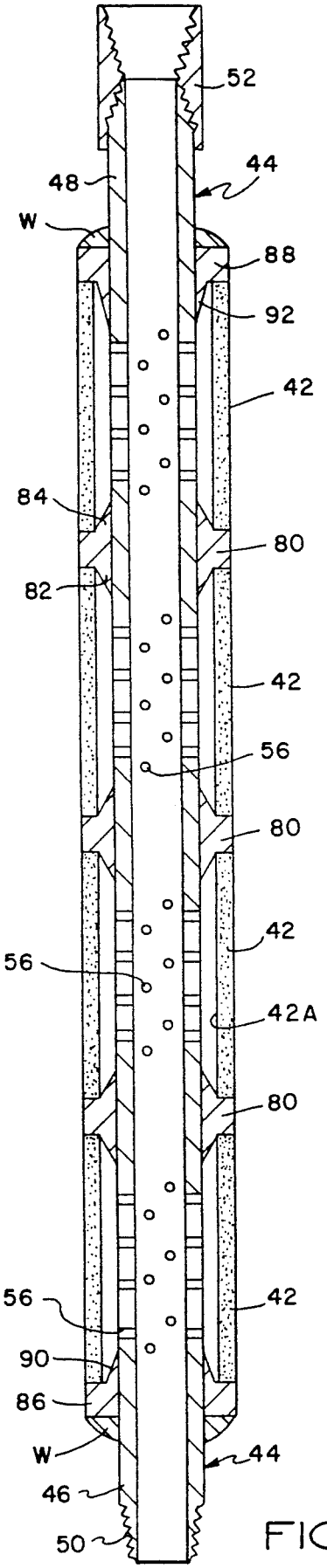
FIG. 14 is a longitudinal sectional view showing an alternative embodiment of the present invention.
Figure 15:
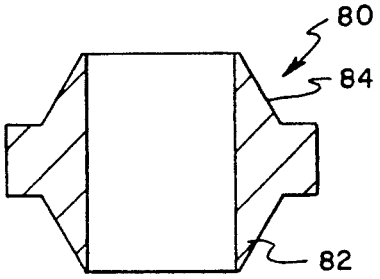
FIG. 15 is a right sectional view of a coupling collar used in the assembly of sintered metal sand screen sections on a perforated mandrel as shown in FIG. 14.
Figure 16:
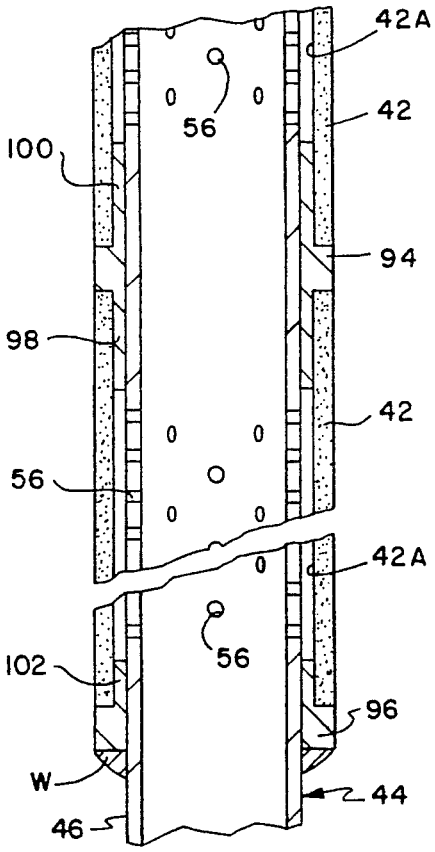
FIG. 16 is a view similar to FIG. 14, showing an alternative coupling collar arrangement.

Referring now to FIG. 14, FIG. 15 and FIG. 16, an alternative embodiment of the invention is illustrated. In this alternative embodiment, resilient seal rings are not utilized, and the sintered metal screen sections 42 are radially offset with respect to the screen mandrel 44. The sintered metal screen sections 42 are supported in radially offset relation with respect to the screen mandrel 44 by annular spacer rings 80. The annular spacer rings 80 have tapered neck portions 82, 84 which automatically center the tubular screen sections 42 in radially spaced relation about the screen mandrel 44. The screen sections are stabilized about the screen mandrel 44 by compression loading applied on opposite ends by end collars 86, 88. The end collars 86, 88 also have tapered neck portions 90, 92 which automatically center and uniformly space the end portions of the outside sintered metal screen sections 42. In this arrangement, the end portions of the screen sections are milled flat to form a right angle annular face for abutment against corresponding annular faces formed on the end collars 86, 88, respectively, and on the intermediate spacer collars 80.

According to an alternative arrangement as shown in FIG. 16, concentric alignment of each tubular screen section 42 is provided by spacer rings 94 and end collars 96 which have cylindrical neck portions 98, 100 and 102, 104, respectively. The neck portions are dimensioned for close, sliding fit within the bore 42A of the sintered metal screen sections. In both embodiments as shown in FIG. 14 and FIG. 16, the screen assembly is relatively inflexible, and is intended primarily for vertical well completions. The mating parts are carefully dimensioned so that a fluid tight, metal-to-metal seal is produced at each joint.

Figure 17:
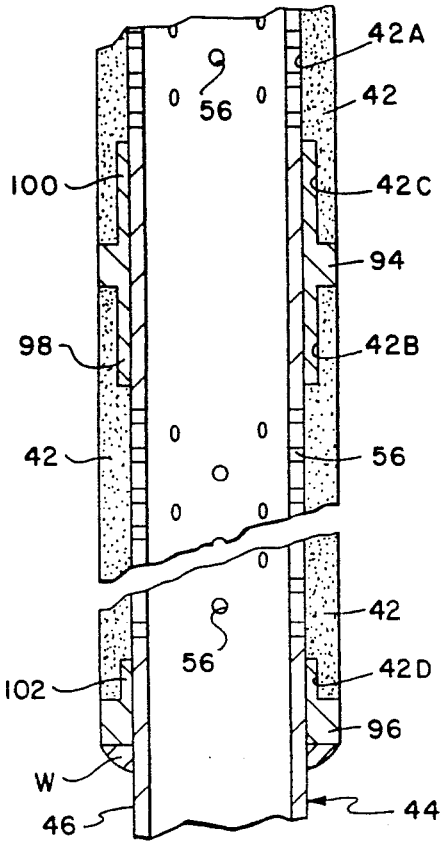
FIG. 17 is a longitudinal sectional view showing an alternative embodiment of the present invention.
Figure 18:
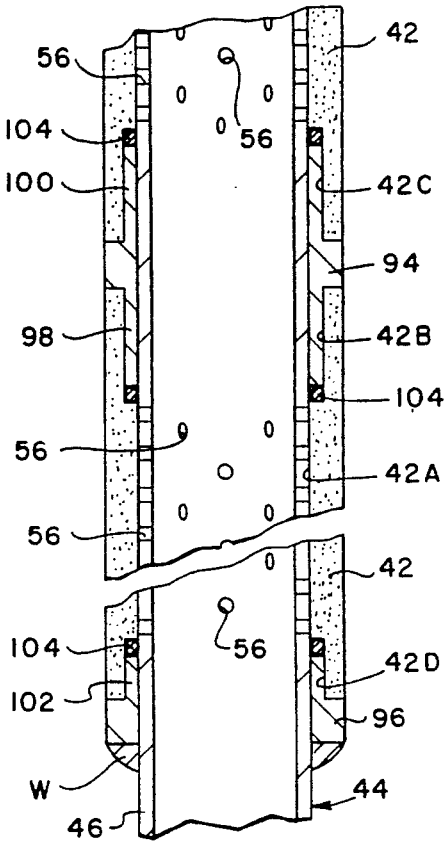
FIG. 18 is a view similar to FIG. 17 showing the sintered metal sand screen sections and coupling collars sealed by annular O-rings.

Referring now to FIGS. 17 and 18, an alternative arrangement featuring concentric alignment of the tubular screen sections 42 is provided by the spacer rings 94, similar to that shown in FIG. 16, but in which the end portions of the sintered metal screen sections 42 are intersected by counterbores 42B, 42C, and the outside end portions being intersected by counterbores 42D, respectively. In this arrangement, the cylindrical neck portions 98, 100 of the spacer rings 94 are received within the counterbores 42B, 42C, respectively, in a metal-to-metal seal. Likewise, the cylindrical neck portions 102 are received within the counterbores 42D in a metal-to-metal seal. The sintered metal screen sections 42 are assembled onto the perforated mandrel 44 as disclosed above. After the sintered metal screen sections 42 are compressed against the spacer rings 94 and the end collars 96, the end collar 96 is spot welded at multiple weld points, and a full weld joint W is formed between the end collar 96 and the screen mandrel 44. In this embodiment, each sintered metal screen section 42 is closely fitted in a slidable union against the external surface of the screen mandrel body 44.

The assembly shown in FIG. 18 is substantially the same as that shown in FIG. 17, except that elastomer O-ring seals 104 are fitted concentrically about the screen mandrel 44. The O-ring seals 104 are received within the annulus lying between the external surface of the screen mandrel 44 and the cylindrical counterbore 42B, 42C and 42D. The elastomer O-ring seals 104 undergo compression as the sintered metal screen sections 42 are compressed, and provide a fluid tight seal at the interface of the screen mandrel 44, the spacer ring neck portions and the sintered metal screen section.

Figure 19:
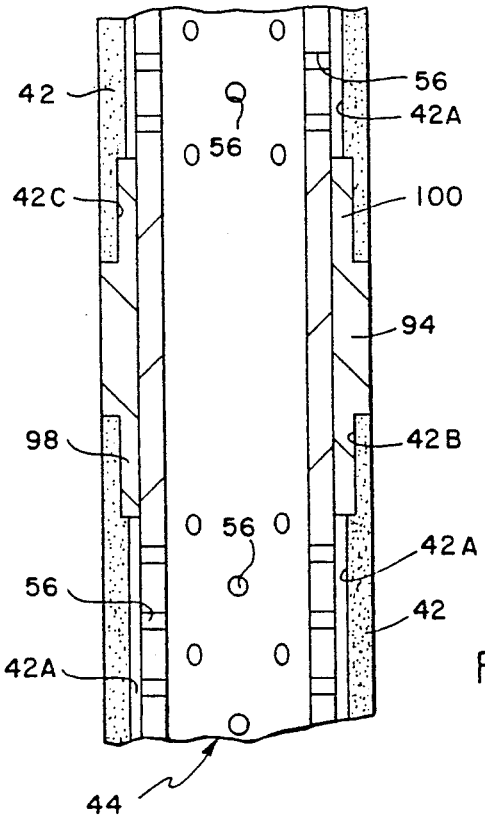
FIG. 19 is a longitudinal sectional view showing an alternative embodiment of the present invention.

Yet another variation is shown in FIG. 19 in which the tubular screen sections 42 are automatically centered in radially spaced relation about the screen mandrel 44, thereby providing an annulus 42A between the sintered metal screen section 42 and the tubular screen mandrel 44. The sidewall radial thickness of the sintered metal screen section 42 and the counterbore radius dimension (42B, 42C, 42D) are carefully selected so that the external surface of the sintered metal sand screen sections 42 are flush with the external surface of the spacer ring 94, and wherein the internal bore of the sintered metal sand screen sections 42 are radially spaced from the Screen mandrel 44, for example, by 1/16th inch, thereby defining a flow bypass annulus. According to this arrangement, bypass flow passages are established across the entire annular interface zone between each sintered metal sand screen section and the screen mandrel. Production flow is not limited or blocked by localized accumulations of sand fines on the external surface of the sand screen sections 42, or by localized deposits of sand fines in the annulus between the sand screen and the screen mandrel body. Because of the radial standoff clearance provided by the annulus 42A, localized bridging or plugging will have no effect on the overall production flow rate, since production flow will be conducted longitudinally as well as circumferentially through the bypass annulus to reach the mandrel perforations 56.

The foregoing embodiments in which the annular spacer rings are used in combination with the resilient O-ring seals 60, 62 provide a resilient, bendable sand screen assembly which can be run through highly deviated well bores. Another advantage of the arrangement whereby the sintered metal sand screen sections are secured on the sand screen mandrel 44 by the annular spacer rings and by the end collars 64, 66 is that the sand screen sections are stabilized without forming a direct weld on the body of the sintered metal screen, which is relatively brittle, and which is subject to mechanical separation as a result of rough handling.

Figure 20:
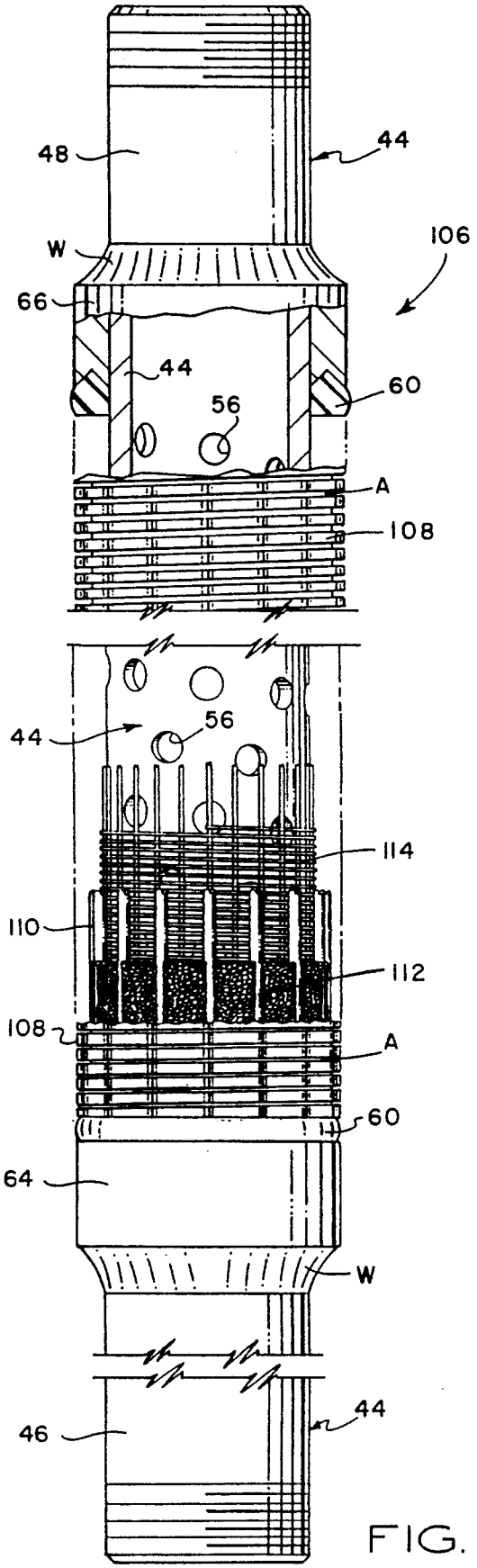
FIG. 20 is an elevational view, partially broken away and partially in section, showing a wire wrap sand screen which is assembled onto a perforated mandrel according to the teachings of the present invention.

The end collar weld rings 64, 66, in combination with the annular seal ring 60, may be used to good advantage with other screen configurations, for example, the wire wrapped screen 106 which is illustrated in FIG. 20. For certain applications, the external wire wrap 108 is formed of a corrosion resistant metal, for example, Type 13 chrome steel. An example of a wire wrap sand screen is disclosed in U.S. Pat. No. 5,004,049 entitled "Low Profile Dual Screen Prepack", assigned to Otis Engineering Corporation, and which is incorporated herein by reference. In such wire wrapped sand screens, the wire wrap is composed of chrome alloy steel wire or the like which is difficult to weld. The present invention provides a method for stabilizing the wire wrapped screen without direct welding attachment of the wire wrap.

According to the present invention, the wire wrapped screen 106 is compressed longitudinally between the end collars 64, 66, with the interface at each end being sealed by the annular seal rings 60. The last wire turn on each end, along with the longitudinal spacer ribs 110, the prepacked gravel material 112 and the inner screen 114 are milled flat for smooth, direct surface engagement against the annular seal rings 60, so that no gap is formed. The wire wrap screen 106 is separately assembled, and is then fitted onto the screen mandrel 44 on an assembly jig as shown in FIG. 11. One end of the collar 64 is compressed against the annular seal ring 60, and the other end of the collar 64 is welded directly onto the screen mandrel 44, as indicated at W. The compression loading is sufficient to produce a fluid tight seal at each screen/collar interface without distorting or closing the longitudinally spaced screen apertures A.

Figure 21:
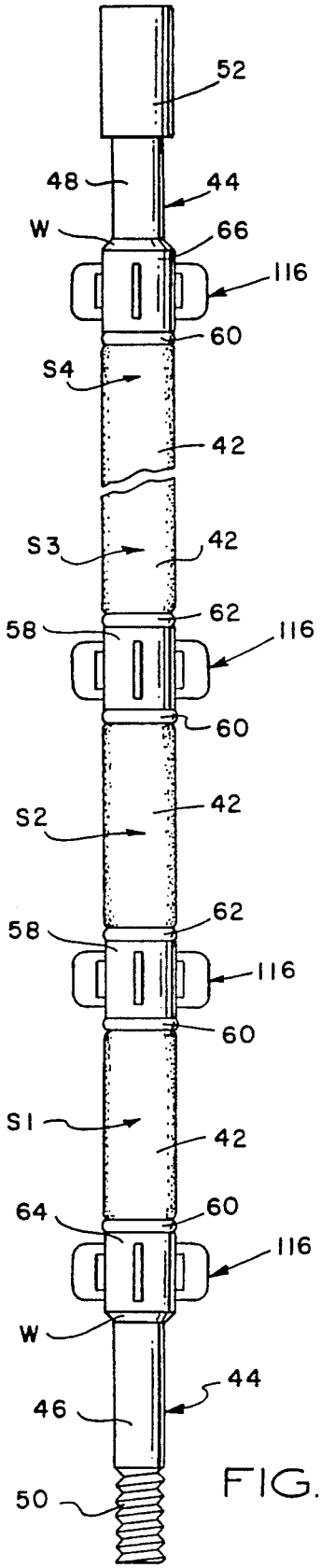
FIG. 21 is a view similar to FIG. 2 in which the multiple sand screen sections are stabilized by centralizer blades attached to the spacer rings; and, FIG. 22 is a simplified sectional view which illustrates the installation of the sintered metal sand screen of the present invention in a horizontal well completion.

Referring now to FIG. 21, the intermediate spacer rings 58 and the end collars 64, 66 are elongated as compared with the corresponding components shown in FIG. 2 to accommodate centralizer blades 116. The centralizer blades are welded directly onto the end collars 64, 66 and onto the spacer rings 58. Preferably, four centralizer blades 116 are attached onto the end collars and spacer rings at symmetrically spaced locations.

Figure 22:
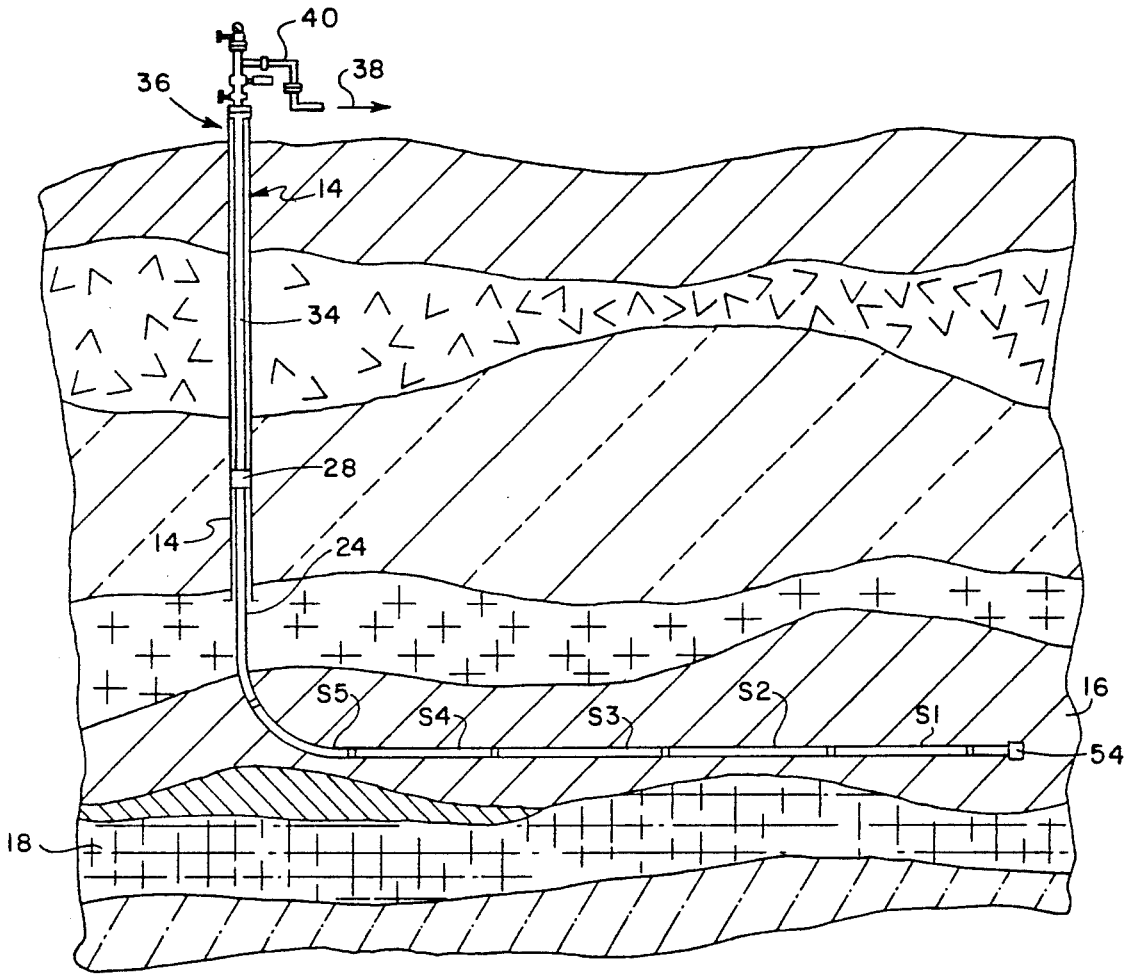

The sintered metal screen assembly 10 can be fabricated in continuous lengths of 20–30 feet (6–9 meters) or more. Consequently, it has a relatively large inflow surface area which is particularly well adapted for use in completions having a relatively low entrance velocity of formation fluids, for example, in a horizontal completion as shown in FIG. 22.

Although the invention has been described with reference to an oil well completion, and with reference to particular preferred embodiments, the foregoing description is not intended to be construed in a limiting sense. Various modifications of the disclosed embodiment as well as alternative applications, for example, filtering unconsolidated material out of inflowing well fluid in water, gas and oil wells, and in environmental wells, including monitoring wells, recovery wells and disposal wells, in horizontal as well as vertical completions, will be suggested to persons skilled in the art by the foregoing specification and illustrations. It is therefore contemplated that the appended claims will cover any such modifications or embodiments that fall within the true scope of the invention.

What is claimed is:

1. A well screen assembly for separating particulated material from formation fluid comprising, in combination:

a mandrel having a tubular sidewall and longitudinally spaced apertures formed radially therethrough;

first and second fluid-porous, particulate-restricting tubular members mounted on said mandrel;

a spacer ring mounted on said mandrel and disposed intermediate the first and second particulate-restricting members; and, first and second resilient seal rings mounted on said perforated mandrel, the first resilient seal ring being disposed between said spacer ring and the first particulate-restricting member, and the second resilient seal ring being disposed between said spacer ring and the second particulate-restricting member.

2. A well screen assembly as defined in claim 1, said fluid-porous, particulate-restricting members each comprising a tubular body of sintered powdered metal.

3. A well screen assembly as defined in claim 1, including first and second annular end collars concentrically including first and second annular end collars concentrically mounted on the perforated mandrel, and third and fourth resilient seal rings concentrically mounted on said perforated mandrel, the third resilient seal ring being disposed intermediate the first annular end collar and the firs fluid-porous, particulate-restricting member, and the fourth resilient seal ring being disposed between the second annular end collar and the second fluid-porous, particulate-restricting member.

4. A well screen assembly as defined in claim 3, wherein said first and second annular end collars are attached to said perforated mandrel by first and second annular welds, respectively.

5. A well screen assembly as defined in claim 1, wherein said annular spacer member is intersected by first and second V grooves, and wherein said first and second annular seal rings have a V-shaped cross section for mating engagement within the annular V grooves of the annular spacer member.

6. A well screen assembly as defined in claim 1, said annular spacer ring being intersected by first and second grooves, and wherein the first and second annular seal members have V-shaped portions for nesting engagement within the V grooves of said annular spacer ring.

7. A well screen assembly as defined in claim 1, said spacer ring having an annular body and first and second tapered neck portions which project axially from said annular body, said first and second fluid-porous, particulate-restricting members being radially spaced from said mandrel.

8. A well screen assembly as defined in claim 1, said spacer ring having an annular body and first and second cylindrical neck portions projecting axially from said annular body, said cylindrical neck portions being received within the bore of the first and second fluid-porous, particulate-restricting tubular members in radially spaced relation with respect to said mandrel.

9. A well screen assembly as defined in claim 1, said spacer ring comprising an annular body and first and second cylindrical neck portions projecting axially from said annular body, and wherein each tubular fluid-porous, particulate-restricting member is intersected by an axial counterbore, wherein the cylindrical neck portions of said spacer ring being received within the axial counterbores of the first and second fluid porous, particulate-restricting tubular members.

10. A well screen assembly as defined in claim 9, including a resilient O-ring seal mounted concentrically about said mandrel and disposed intermediate the cylindrical neck portion of said spacer ring and the fluid-porous, particulate-restricting tubular members.

11. A well screen assembly as defined in claim 1, said spacer ring having an annular body and first and second cylindrical neck portions projecting axially from said annular body, and the first and second fluid-porous, particulate-restricting tubular members each having end portions intersected by axially extending counterbores, said axially extending cylindrical neck portions being received within said counterbores, the first and second fluid-porous, particulate-restricting tubular members being radially spaced with respect to said mandrel.

12. A well screen assembly as defined in claim 1, including a plurality of centralizer blades attached to said spacer ring, said centralizer rings being angularly spaced with respect to each other about the periphery of said spacer ring.

13. A well screen assembly for separating particulated material from formation fluid comprising, in combination:

a mandrel having a tubular sidewall and longitudinally spaced apertures formed radially therethrough;

a fluid-porous, particulate-restricting member mounted on said mandrel;

first and second annular end collars mounted on the perforated mandrel;

first and second resilient seal rings mounted on said perforated mandrel, the first resilient seal ring being disposed intermediate the first annular end collar and one end of said fluid-porous, particulate-restricting member, and the second resilient seal ring being disposed between the second annular end collar and the opposite end of said fluid-porous, particulate-restricting member.

14. A well screen assembly as defined in claim 13, wherein said first and second annular and collars are secured to said perforated mandrel by first and second annular welds, respectively.

15. A well screen assembly as defined in claim 13, wherein said fluid-porous, particulate-restricting member comprises longitudinally extending ribs and a screen wire wrapped externally about said ribs in a longitudinally spaced pattern, thereby defining longitudinally spaced screen apertures for conducting formation fluids.

16. A well screen assembly as defined in claim 15, wherein said screen wire comprises steel alloyed with chrome.

17. A well screen assembly for separating particulated material from formation fluid comprising first and second tubular screen sections mounted on a perforated mandrel, said tubular screen sections being separated by an annular spacer ring and by first and second annular, resilient seal rings, with longitudinal compression loading being maintained on the tubular screen sections and seal rings by first and second end collars, said end collars being attached to said perforated mandrel.

18. A well screen assembly as defined in claim 17, wherein each end collar is attached to said perforated mandrel by a weld joint.

19. A well screen assembly for separating particulated material from formation fluid comprising a perforated, tubular mandrel and first and second tubular screen sections concentrically received about said perforated mandrel, said screen sections being separated by an annular, resilient seal ring, and being confined by first and second end collars attached to said perforated mandrel.

20. A well screen assembly for separating particulated material from formation fluid comprising a fluid-porous, particulate-restricting tubular screen member mounted on a perforated mandrel, first and second annular end collars attached to said perforated mandrel on opposite ends of said tubular screen member, said tubular screen member being separated from said end collars by first and second resilient seal rings, respectively, with longitudinal compression loading being maintained on said tubular screen member by said first and second end collars.

21. A well screen assembly as defined in claim 20, wherein each end collar is attached to said screen mandrel by a weld joint.

* * * * *